United States Patent [19]

Charleton

[11] Patent Number: 5,002,212

[45] Date of Patent: Mar. 26, 1991

[54] EMERGENCY IDENTIFICATION BAND

[76] Inventor: Joanna A. Charleton, 21571 Bahama La., Huntington Beach, Calif. 92646

[21] Appl. No.: 459,634

[22] Filed: Jan. 2, 1990

[51] Int. Cl.[5] ..... A44C 5/18

[52] U.S. Cl. ..... 224/221; 40/633; 40/665; 24/442

[58] Field of Search ..... 224/221, 219, 901; 40/633, 665, 304, 300; 24/306, 442; 128/DIG. 15

[56] References Cited

U.S. PATENT DOCUMENTS

| | | | |
|---|---|---|---|
| 1,427,891 | 9/1922 | Ziegler | 224/219 |
| 2,599,311 | 6/1952 | Anderson | 224/219 |
| 3,106,028 | 10/1963 | Baum Gartner | 224/221 |
| 4,239,136 | 12/1980 | Godwin | 224/219 |
| 4,341,331 | 7/1982 | McDougall | 224/219 |
| 4,489,867 | 12/1984 | Schwemberger | 224/219 |
| 4,836,427 | 6/1989 | McManus | 224/901 |

FOREIGN PATENT DOCUMENTS

| | | | |
|---|---|---|---|
| 3023668 | 1/1982 | Fed. Rep. of Germany | 224/219 |

*Primary Examiner*—Linda J. Sholl

[57] ABSTRACT

A band of self-fastening fabric, with a ring for adjusting and securing, and a holding panel attached to the fastening fabric forming an opening to carry emergency identification information.

7 Claims, 1 Drawing Sheet

EMERGENCY IDENTIFICATION BAND

BACKGROUND OF THE INVENTION

1. Field of the Invention

This invention relates generally to a flexible and adjustable band and more particularly to a band with a holding panel which carries an emergency identification card.

2. Cross-Reference to Related Application

My own design patent application Ser. No. 07/052,353 is an adjustable identification carrying band. I have improved this design by adding a ring on the end of the band allowing the band to be secured tightly and comfortably, and also by using a thumb cut on the holder panel for easier access to Insert and remove the identification card, and also by using double sided loop self-fastening fabric to provide greater adjustability.

3. Description of Prior Art

Currently, emergency identification information is commonly engraved on metal bands. These bands require that information be sent in to the company to be engraved onto the band. This permanently engraved information becomes outdated with any change of information, and the band becomes obsolete.

Other metal emergency bands state only a health problem, such as diabetic, with no other information.

Delays are involved in obtaining information by telephone from computerized identification services.

This invention remedies these problems. It is an object of this invention to be fully adjustable and to provide a means of having immediately available information, such as personal, health and medical insurance information in case of emergency.

SUMMARY OF THE INVENTION

This invention is an emergency identification band. The band is flexible and adjustable and provides certain advantages. The band:

a. can be secured to wrist or a smaller object such as a bicycle handlebar, ski pole, cane and walker; and b. provides a means of carrying emergency identification which is secure and comfortable while involved in sports and exercise activities such as walking and running; and c. carries a hand written information card which is easily changed and to keep information current; and d. will carry a large folded information card which is able to hold such information as family members to contact, health and insurance policy numbers and information.

These advantages make it possible for everyone to have immediately available information in case of an emergency. The band can be worn while involved in sporting activities, placed on sporting or health equipment, and always kept easily and readily available.

Other features will be apparent and pointed out.

Figure 1:
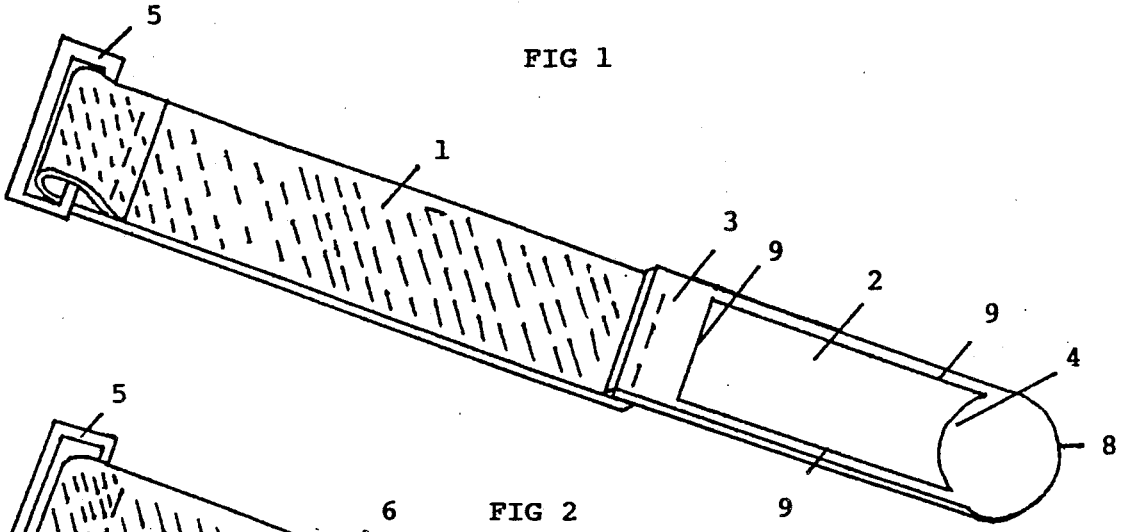
FIG. 1 is a top view of the emergency identification band.
Figure 2:
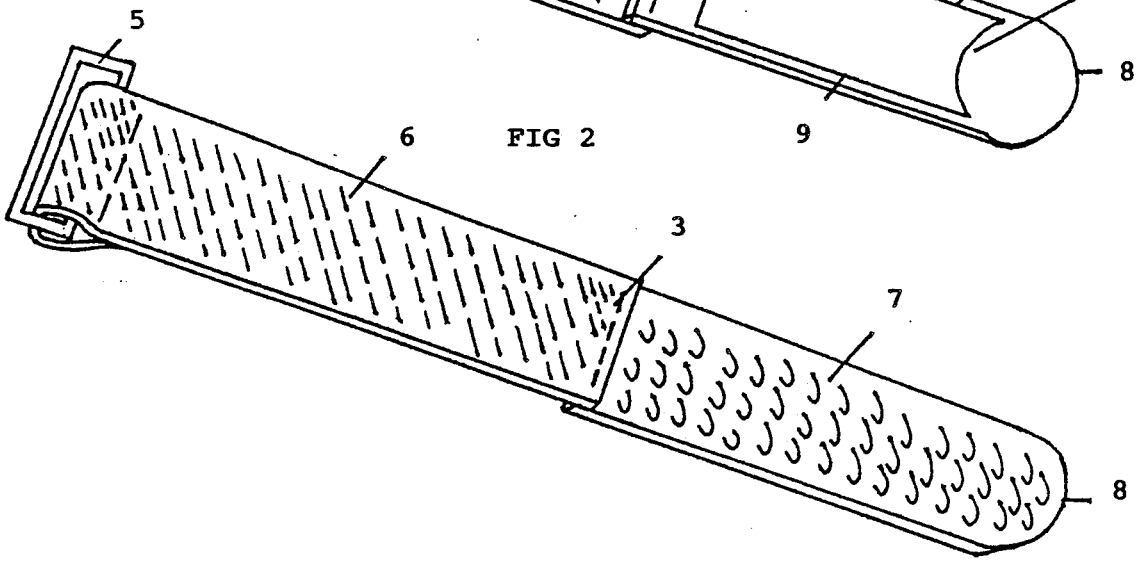
FIG. 2 is a bottom view of the band.
Figure 3:
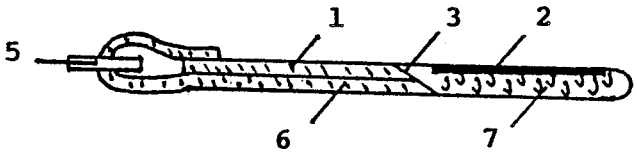
FIG. 3 is a side elevation view.
Figure 4:
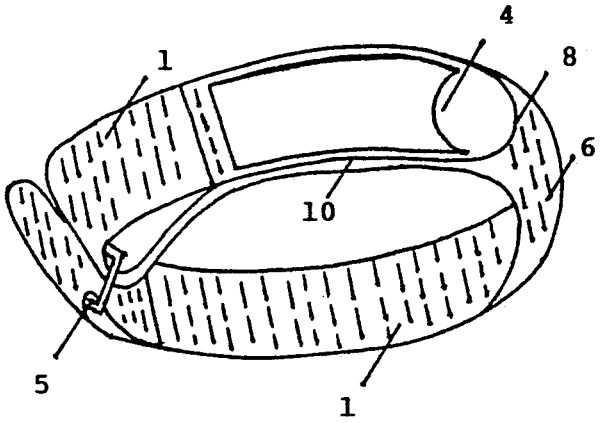
FIG. 4 is a view showing the band wrapped around the wrist or mounted on a tube type object such as a bicycle frame and showing the self-fastening fabric attached.

REFERENCE NUMBERS IN DRAWINGS 1. loop fastening fabric
2. holder panel
3. seal for hook and loop sections
4. opening
5. ring
6. loop fastening fabric
7. hook fastening fabric
8. tapered edge
9. seals for holder panel
0. hook and loop fastening fabric secured

DESCRIPTION OF THE PREFERRED EMBODIMENT

Referring to the drawings an embodiment of the emergency identification band is shown.

In this embodiment a strip of double sided loop fastening fabric 1 is secured to a strip of hook fastening fabric 3. This fabric may be tapered on the edge 8. This hook fabric can have a special sealable backing. To the back of this hook fabric 7, a material, preferably a flexible strip of plastic 2, is attached on three edges 9, forming a holder panel 2, and an opening 4.

The open side allows for the insertion and removal of the identification card. The holder panel 2 can have a thumb cut for easier access to the identification card.

The ring 5 is attached to the end of the loop strip 1. The back 6 is a double sided loop attached 3 to hook fastening fabric 7.

In the use of the band an identification card is inserted into 4. End 8 is put through ring 5, hook side up, and adjusted to the desired size and the hook 7 is pressed and secured to 1 or 6 the loop, bringing the hook and loop fabric together to secure the band 10.

The band can be worn when desired or mounted on any article such as sporting or medical equipment.

Although one detailed embodiment of the invention is illustrated in the drawings and previously described in detail, it is intended that all material in the above description or shown in the accompanying drawings shall be interpreted as illustrative and not in a limiting sense.

I claim:

1. An emergency identification band that can be secured to the wrist or onto bicycles, golf bags, tennis rackets or wheel chairs and walking aids which comprises:

a. two sections of loop self-fastening fabric, having a looped face and a fabric back: and b. placing the two sections back to back and sealing both sections together to form one section having loop face on both sides: and c. a section of hook self-fastening fabric having a hooked face and a fabric back: and d. overlapping a narrow strip of the end of the loop over a narrow strip of the hook and sealing to form a one length band having one section of loop on both sides and one section of hook on the face and fabric on the back: and e. a section of plastic material attached along three sides of the back side of the hook fabric forming a holding pocket into which can be inserted an information card which can be folded to contain extensive information, which can be removed and replaced whenever information changes, or removed whenever necessary by emergency personnel: and f. a ring attached to the end of the loop section through which the hook section is pulled to wrap back engaging hook fabric to loop fabric securing band.

2. An emergency identification band as described in claim 1 with a section of transparent plastic material attached along three sides of the fabric back of the hook fastening fabric forming a see through holding pocket through which the identification information card can be seen.

3. An emergency identification band as described in claim 1 with a section of opaque plastic material attached along three sides of the back of the hook fastening fabric forming an opaque holding pocket for the identification information card.

4. An emergency identification band as described in claim 1 with a section of fabric material attached along three sides of the back of the hook fastening fabric to form a pocket for the identification information card.

5. An emergency identification band as described in claim 1, having a thumb cut along the holding pocket material to provide for easier insertion and quicker removal of the identification information card.

6. An emergency identification band as described in claim 1, having a straight edge along the holding pocket material.

7. An emergency identification band as described in claim 1, with one section of self-fastening loop fabric having a looped face and a fabric back.

* * * * *